United States Patent [19]

Whitney

[11] Patent Number: 4,598,433

[45] Date of Patent: Jul. 8, 1986

[54] SHOWER DOOR STALL ASSEMBLY

[75] Inventor: Thomas H. Whitney, Attica, Mich.

[73] Assignee: Trayco, Inc., Lapeer, Mich.

[21] Appl. No.: 611,585

[22] Filed: May 18, 1984

[51] Int. Cl.[4] ..... A47K 3/22

[52] U.S. Cl. ..... 4/607; 4/557

[58] Field of Search ..... 4/608, 607, 496, 557

[56] References Cited

U.S. PATENT DOCUMENTS 4,491,990 1/1985 Robinson et al. ..... 4/607

FOREIGN PATENT DOCUMENTS 0018299 4/1970 European Pat. Off. ..... 4/596

*Primary Examiner*—Henry K. Artis

*Attorney, Agent, or Firm*—Edgar A. Zarins; Steven L. Permut; Malcolm L. Sutherland

[57] ABSTRACT

A shower stall assembly includes a one-piece molded PVC door that has an outwardly curved main section, integral handles and an outer perimeter which overlaps the perimeter frame about the opening of a shower stall. The shower stall has a header section which connects two sliders, each on a transverse rail member. One rail member spans the shower stall opening and the other rail member extends rearwardly to the rear shower stall wall. The shower stall door can be pivoted inwardly from its closed position to an open position in the shower stall.

12 Claims, 9 Drawing Figures

SHOWER DOOR STALL ASSEMBLY

TECHNICAL FIELD

This invention relates to shower stalls and more particularly, to shower stall door and rail assemblies.

DISCLOSURE INFORMATION STATEMENT

Most commonly, shower stall doors are made for bathtubs such that two door panels can be slidably mounted in tracks side by side such that when one of the doors is open, it slides behind the other to create an opening to the tub. These shower stall doors are commonly a pane of plastic or glass mounted in a frame that has rollers slidably mounted within a track. Furthermore, these doors can have a pivoting mechanism to allow them to pivot out of the track to allow for greater accessability to the bathtub. See U.S. Pat. Nos. 3,025,574 and 3,025,937, both issued to Finkel on Mar. 20, 1962. One particular shower door for a bathtub has a track section mounted along each side wall to allow the door roller to roll therein for storage purposes. See U.S. Pat. No. 4,388,778 issued to Brooke on June 21, 1983.

Shower stalls which are approximately only three feet long and three feet wide do not have the advantages of shower stall door assemblies for bathtubs; namely, there is no room for a double door assembly. Consequently, shower stalls commonly have a single door pivotally mounted about a side edge to pivot outwardly from the shower. However, these single pivoting doors have certain disadvantages. Even though many of these doors have bottom drain rails, the inertia of the water as the door is swung open forces the water to the outer edge of the drain rail where it often spills onto the bathroom floor.

Secondly, these pivoting doors are never pivoted inward to the shower stall because a person cannot step around the door conveniently to close the door while that person is in the shower stall. The outward swing of the door also requires a certain clearance on the bathroom floor free from a sink, a toilet or other fixtures. Therefore, these doors are non-operative in a bathroom where there is no room for a door to pivot outwardly. Consequently, shower stalls in small bathrooms commonly do not have doors but merely have a shower curtain hanging from a rod or are open with no curtain or other splash protection.

What is needed is a shower door assembly for a shower stall that is simple to install, keeps the bathroom floor dry, opens into the shower stall, and is easily cleanable without being unduly expensive.

SUMMARY OF THE INVENTION

According to one aspect of the invention, a shower door for a shower stall is a one-piece panel being sufficiently rigid to maintain its shape and having an outwardly directed bow to increase structural strength and increase the interior space in the shower stall. Preferably, the panel has integrally formed bosses forming a handle and an integrally formed peripheral flange overlapping the perimeter of the door opening when the door is in a closed position.

According to another aspect of the invention, a shower door for a shower stall is pivotally attached to first and second slider members which are slidably mounted about first and second rails respectively. Preferably, each slider member has a notch at one end with the pivotable connection to the door positioned directly below the notch such that when the door is in the full open or the full closed position, the notch of one slider member receives one rail member and both pivotable connections are aligned directly under the one rail.

Preferably, the rails are connected to each other to form a rail assembly with the first rail being mounted on two recesses within opposing door jams and the second rail having one end connected to the first rail and its rear end mounted within a recess at a rear wall of the shower stall. Preferably, the rail assembly snap fits within the recesses.

According to another aspect of the invention, a shower stall door is mounted on two sliding members such that the center mass of the door is laterally displaced from the axis defined by the two sliding members such that the door, when in the closed position, is biased outwardly such that the peripheral flange is forced to abut the perimeter of the door opening thereby preventing water from splashing out of the shower stall.

A shower stall door can be easily mounted on the sliding rail members. The shower stall door can be pivoted to an open position inwardly into the shower stall thus preventing water from spilling out into the bathroom floor. The door pivots and slides in such a fashion so as not to intrude into the center area of the shower stall, i.e., the person taking a shower does not have to move out of the way of the moving door.

Since the shower stall door pivots inwardly into the shower stall, only the square footage the shower stall takes up is needed within the bathroom for fitting this shower stall. Consequently, the shower stall can be placed in smaller sized bathrooms that would not provide the space for a door pivoting outwardly from the shower stall.

Furthermore, the outwardly bowed shape of the door provides more interior room when the shower stall door is closed and increases the structural integrity of the door.

BRIEF DESCRIPTION OF THE DRAWINGS

Reference is now made to the accompanying drawings in which.

DETAILED DESCRIPTION OF A PREFERRED EMBODIMENT

Figure 1:
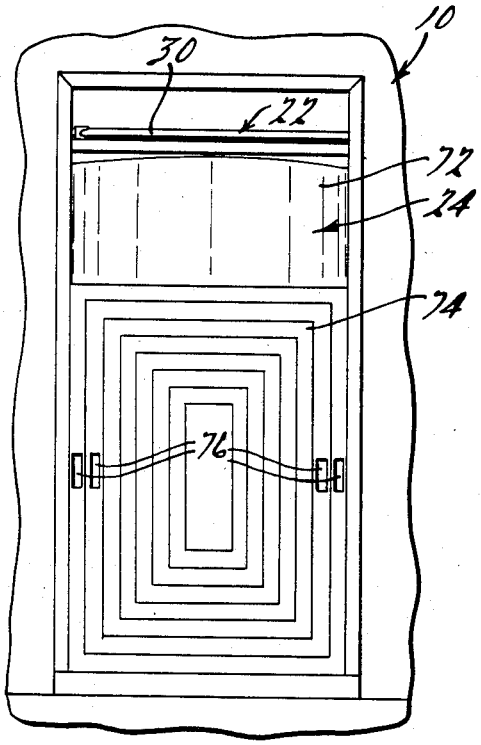
FIG. 1 is a front elevational view of a shower stall, shower stall door, and rail assembly according to the invention with the shower door shown in the closed positions.
Figure 2:
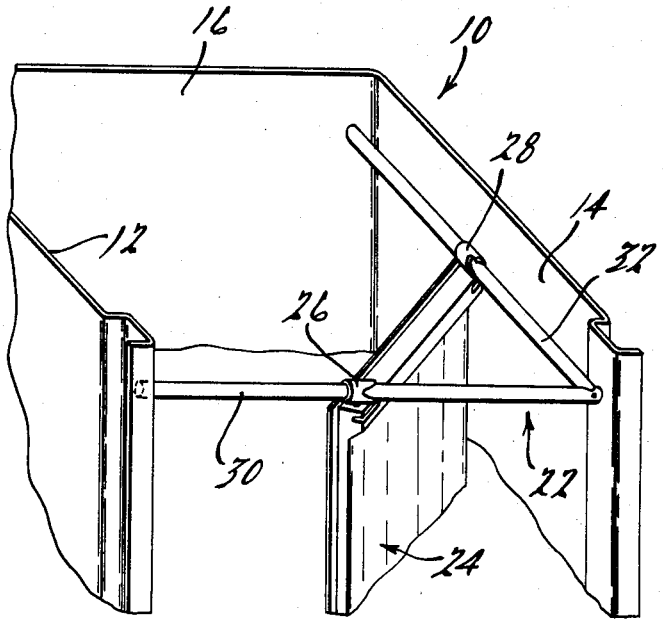
FIG. 2 is fragmentary perspective view of the shower stall shown in FIG. 1 with the door in an intermediate position between the full open and full closed position.
Figure 3:
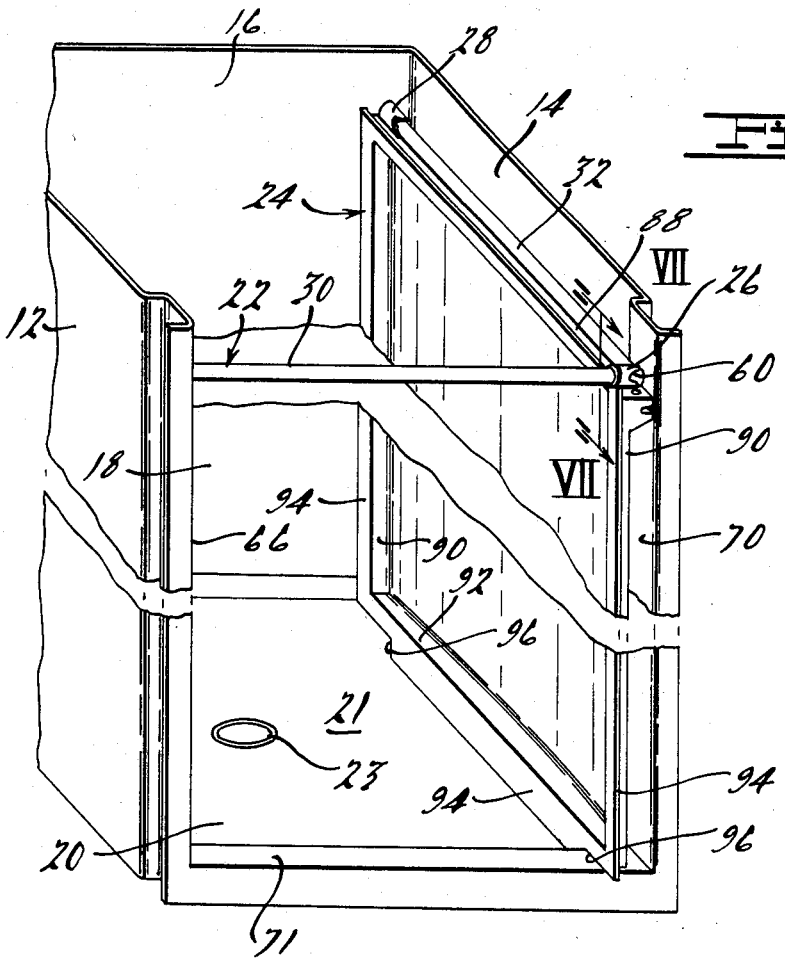
FIG. 3 is a fragmented perspective view of the shower stall with the door in the full open position.

Referring to the figures, particularly FIGS. 1–3, a shower stall 10 has three walls 12, 14, 16, all made from PVC plastic forming a front opening 18. The walls are mounted on a substantially square floor section 20 which has a central section 21 with a drain 23. A rail assembly 22 is secured to the shower stall and the door 24 is connected to two sliders 26 and 28 which slide on rail assembly 22.

Figure 4:
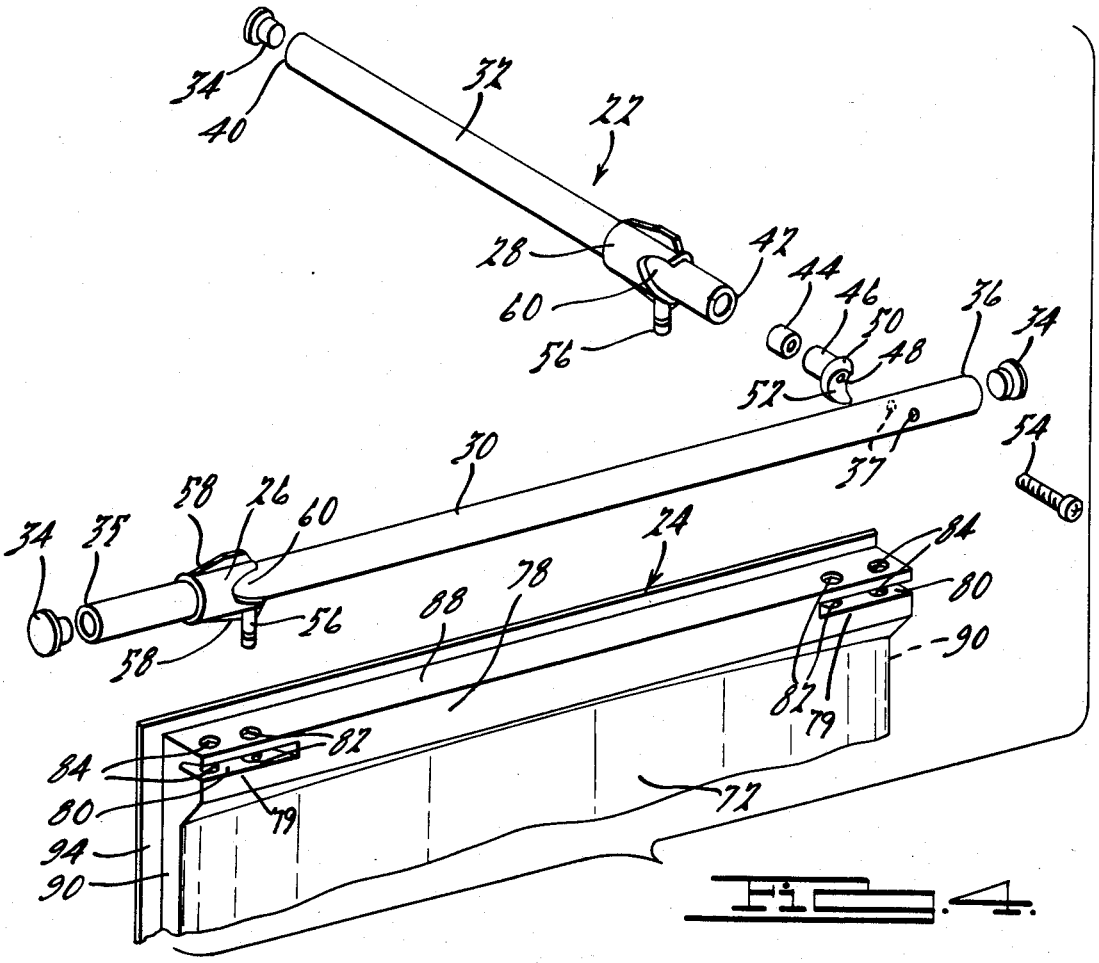
FIG. 4 is an enlarged exploded and fragmented view of the door and rail assembly.

Referring to FIG. 4, the rail assembly 22 includes a first tubular rail member 30 and a second tubular rail member 32. The first tubular rail member 30 has plastic caps 34 at each end 35 and 36. A pair of oppositely positioned apertures 37 pass through member 30 in proximity to end 36.

Member 32 has a plastic cap 34 placed at end 40. End 42 has a plug 44 which is pressed fitted within tube 32 and a fitting 46 which has an axial extending aperture 48 therethrough. The outer contour 50 of fitting 46 aligns with the outer surface of member 32 and has a notch 52 therein which conforms with the outer surface of member 30. A threaded fastener 54 passes through apertures 37 and 48 and threadably engages plug member 44 such that the rail members 30 and 32 are secured in a V-shaped configuration as shown in FIG. 9.

Figure 7:
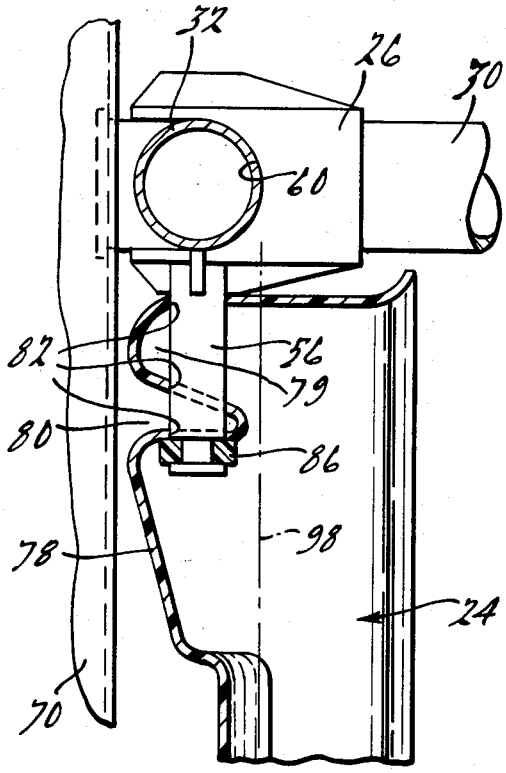
FIG. 7 is an enlarged segmented view taken along the line VII—VII shown in FIG. 3.
Figure 8:
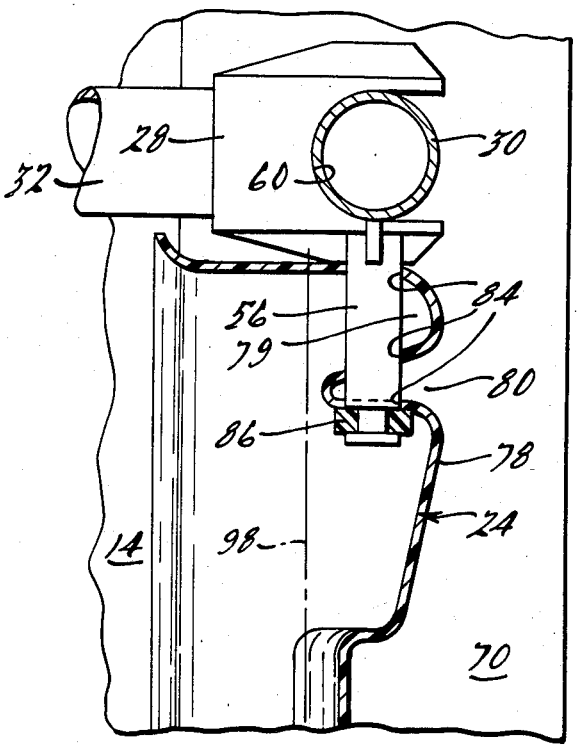
FIG. 8 is an enlarged segmented view of the shower stall door as taken along lines VIII—VIII shown in FIGS. 5 and 6.

Each rail member 30 and 32 has a slider 26 and 28 slidably mounted thereon respectively. Since each slider 26 and 28 is identical, reference now will be made only to slider 26. Slider 26 is tubular in shape with a central axial bore 55 and integral downwardly extending stud 56 and two structural reinforcing fins 58. Two notches 60 are positioned directly above the stud 56. The notches 60 are sized to laterally receive one of the rail members 30 or 32 as shown in FIGS. 3, 7 and 8.

Figure 9:
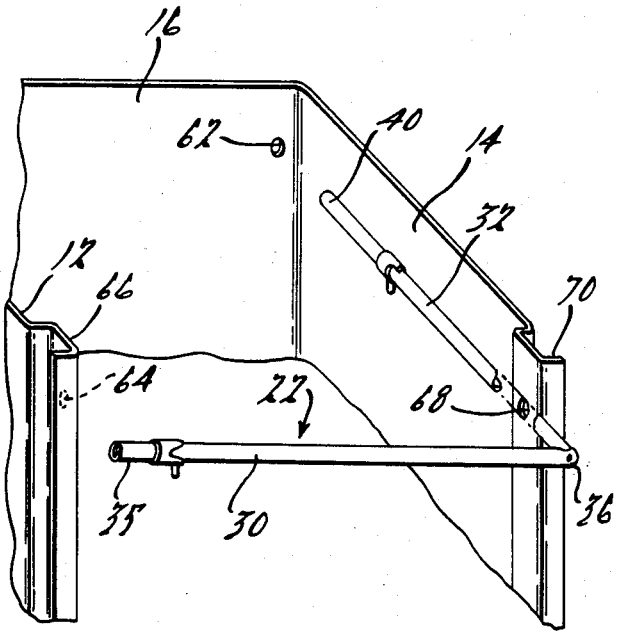
FIG. 9 is a view showing the rail assembly before being secured to the shower stall.

Referring to FIG. 9, after the rail assembly 22 is assembled, end 40 is placed within recess 62 in rear wall 16 and end 35 is placed in recess 64 in the door jam 66 of side wall 12. The assembly 22 is then pivoted until end 36 snap fits into recess 68 in door jam 70 of side wall 14. The rail member 30 spans an upper portion of opening 18 and rail member 32 extends rearwardly into the shower stall.

Referring back to FIGS. 1–8, the door 22 is suspended from the studs 56 of the slide members 26 and 28. The door member 22 is a one-piece vacuum formed PVC plastic member that can be transparent with a smoked tint to allow light to pass therethrough and into the shower stall. The door 24 has an outwardly bowed main section 72 with decoration 74 embossed therein. The decoration 74 can have bosses 76 therein to form an integral handle which can be grasped.

Figure 6:
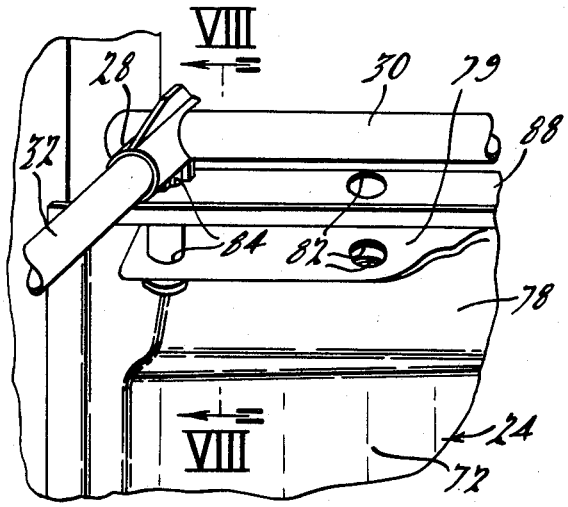
FIG. 6 is an enlarged fragmentary and perspective view of the upper left corner of the shower stall assembly as seen from the interior thereof.

In addition, the door 24 has a header section 78. The header section 78 has two convoluted end areas 79 to form grooves 80. The convoluted plastic forms three layers that have inner apertures 82 and outer apertures 84 coaligned such that the stud 56 can pass through either apertures 82 or 84 and be locked thereon with a retaining member 86. As shown in FIG. 6, slider 28 on rail member 32 is fitted within the outer apertures 84. Slider member 26 on rail member 30 is fitted through the inner set of apertures 82.

Figure 5:
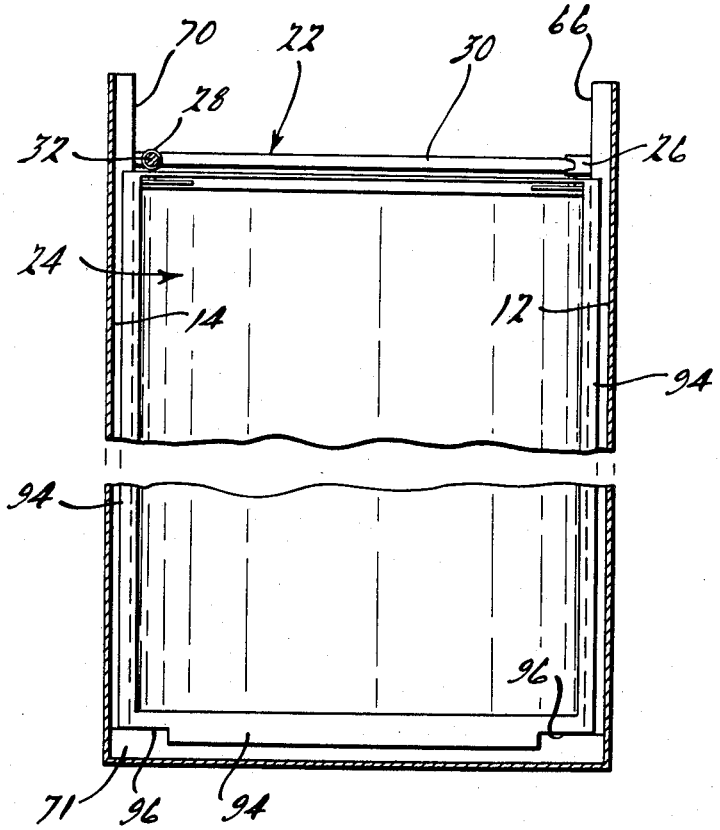
FIG. 5 is a fragmented rear elevational view of the shower stall door assembly from the interior of the shower stall with the door in the full closed position.

The top wall 88 of the header section 78, two side walls 90, and the bottom wall 92 are joined to form a peripheral rib that is substantially transverse to the main section 72 of door 24. At the rear of the walls 88, 90 and 92 is an outwardly extending flange member 94. Flange member 94 has two notches 96 at each bottom end thereof as shown in FIGS. 3 and 5.

When the shower door is in the closed position as shown in FIGS. 1, 5, 6 and 8, it spans the full width of the door opening 20 such that the flange 94 overlaps a portion of door jams 66, 70 and raised floor ledge 71. As can be seen, there is no gap between the door jams 66, 70 and ledge 71 with the door 24. Water is thus prevented from splashing out therethrough.

Furthermore, as shown in FIGS. 7 and 8, the stud is connected to the door member 24 along an axis which is laterally spaced from the axis 98 that contains the center mass of the door. As such, the door 24 tends to be biased outwardly from the shower stall and does not freely swing into the shower stall if accidentally knocked from the exterior side. The flange 94 acts as a stop against the frame members 66, 70 and 71 which assumes that no gap exists therebetween to provide for a basically leak-proof abutment when the shower door is in the closed position.

In addition, the ability of slider 28 to receive rail member 30 therein allows for the stud member 56 to align directly under the rail member 30. Therefore both stud members 56 of both sliders 26 and 28 are positioned directly under rail member 30 to align the door with rail member 30. In this fashion, there is no skewed door that is partially closed. The door is fully closed and renders an aesthetically desirable straight appearance.

As shown in FIGS. 2 and 3, when the door is pivoted to the open position, it is moved and pivoted into the shower stall 10. In this fashion, any water draining downward from the door or from bottom wall 92 drains into the shower stall floor 20 rather than on the bathroom floor. The notch 96 allows for the door 24 to pass over the raised floor ledge 71. As shown in FIG. 2, pivoting of the door cuts off only a small fraction of the shower stall space and does not intrude into the center area and get in the way of the person therein. A person within the shower stall can easily operate the door from the open to the closed position and vice versa.

In addition, as shown in FIG. 7, when the door is in the full open position, slider member 26 receives rail member 32 such that the door can be perfectly aligned with the rail 32 in the same fashion as it is aligned with the rail 30 when in the closed position.

In addition the rail assembly and door can be mounted for either right or left side opening of the door 24. In order for the door to be opened to the other side from that shown, the rail assembly 22 is merely flipped over so that the rail member 32 is adjacent wall 12. The sliders 26 and 28 are repositioned accordingly.

The outward bow of section 72 of door 22 provides structural support for the door 22. Furthermore it provides more interior room in the shower stall when the door is in the closed position.

Variation and modifications of the present invention are possible without departing from its scope and spirit as defined by the appended claims.

The embodiments of the invention in which an exclusive property or privilege is claimed are defined as follows:

1. A shower door for a shower stall, said door characterized by:

a panel being sufficiently rigid to maintain its shape;

said panel being bowed outwardly to increase the interior space in said shower stall;

said panel being an integrally formed one-piece plastic material;

said panel having at least two bosses forming a handle integral with said panel; and means for pivotally and slidably moving said panel from an open to a closed position.

2. A shower door for a shower stall, said door characterized by:

a panel being sufficiently rigid to maintain its shape;

said panel being bowed outwardly to increase the interior space in said shower stall;

said panel being an integrally formed one-piece plastic material;

said panel having an integrally formed peripheral rib extending substantially perpendicular from the central area of said panel to form a frame and an integral splash protective flange extending radially outwardly from said rib and substantially parallel to said central area; and said door being sized to fit within a door opening defined by a perimeter shoulder with said splash protective flange overlapping the door opening perimeter when said door is in a closed position.

3. A shower door assembly characterized by:

a door;

an upper rail assembly for supporting said door and for guiding movement of said door between a closed position and an open position;

said rail assembly including:

a first rail fixedly mounted to horizontally span an opening in a shower stall;

a second rail fixedly mounted to extend rearwardly from said opening into said shower stall;

a first slider member slidably mounted about said first rail section;

a second slider member slidably mounted about said second rail section; and said door having a pivotable connection (pivotally connected) to said slider members for movement between said closed position and open position;

said first slider being at a distant end of said first rail section from said second rail section and said second slider being adjacent said first rail section with the pivotable connection between the second slider member and the door vertically aligned with said first rail section when said door is in the closed position and said first slider being adjacent said second rail section with the pivotable connection between the first slider member and the door being vertically aligned with the second rail section and a second slider being at a distant end of said second rail section with respect to said first rail section when said door is in the open position.

4. A shower door assembly as defined in claim 3 further characterized by:

one of said rails having a first end connected to the other of said rails.

5. A shower door assembly as defined in claim 4 wherein;

the other of said rails having each end affixed to a support member of a shower stall;

said one of said rails having said first end connected to an intermediate section of said other of said rails; and said one of said rails having an opposite end connected to a wall of said shower stall.

6. A shower door as defined in claim 5 wherein;

said ends of said other of said rails and said first end of said one of said rails are received in a recess of said shower stall in a snap-fit relationship.

7. A shower door assembly as defined in claim 3 further characterized by:

each slider having a depending lug extending downwardly; said door pivotably connected to said sliders via said depending lug on each slider.

8. A track assembly for a shower door that moves from a closed position spanning the shower stall opening to an open postion within the shower stall, said track assembly comprising;

a first member horizontally disposed in and spanning an upper portion of said shower stall opening;

securing means for securing a first and second ends of said first member to said shower stall;

a second member horizontally disposed and extending rearwardly from the opening of said shower stall with one end secured to said first member; and said securing means securing a second end of said second member to said shower stall.

9. A track assembly as defined in claim 8 wherein said securing means includes recesses in said shower stall sized to receive the ends of said first member and the second end of said second member.

10. A track assembly as defined in claim 9 wherein said first and second members snap fit into said recesses.

11. A shower door assembly for a shower stall, said assembly characterized by:

a door;

tubular rail means having at least one tubular rail securely mounted above said door;

tubular sliders slidably mounted about said rail; and means for pivotally suspending said door from said sliders allowing said door to pivotably and slidably move from an open to a closed position.

12. A slider mechanism for a shower door assembly, said slider mechanism characterized by:

a tubular slider member having an axial bore therethrough sized to slidably receive a rail;

a stud extending downwardly proximate one end of said slider, a shower door being pivotally connected to said stud; and said one end of said slider having aligned substantially parabolic notches positioned on radial opposite sides and horizontally displaced from each other, said notches conforming to the outer circumference of said rail such that said notches can laterally receive said rail.

* * * * *